US007971581B1

(12) United States Patent
Guilas

(10) Patent No.: US 7,971,581 B1
(45) Date of Patent: Jul. 5, 2011

(54) AIR INTAKE ACCESSORY FOR AN AUTOMOBILE ENGINE

(76) Inventor: Michael Guilas, East Vallejo, CA (US)

( * ) Notice: Subject to any disclaimer, the term of this patent is extended or adjusted under 35 U.S.C. 154(b) by 254 days.

(21) Appl. No.: 12/393,433

(22) Filed: Feb. 26, 2009

(51) Int. Cl.
*F02M 29/02* (2006.01)

(52) U.S. Cl. ..... 123/592

(58) Field of Classification Search ..... 123/590, 123/592
See application file for complete search history.

(56) References Cited

U.S. PATENT DOCUMENTS

| | | | | |
|---|---|---|---|---|
| 3,942,499 | A * | 3/1976 | Kunik et al. | 123/518 |
| 3,955,548 | A * | 5/1976 | Thomas, Jr. | 123/592 |
| 5,113,838 | A | 5/1992 | Kim | |
| D355,420 | S | 2/1995 | Cho | |
| 5,947,081 | A | 9/1999 | Kim | |
| 6,158,412 | A | 12/2000 | Kim | |
| 6,550,446 | B1 | 4/2003 | Robley, Jr. | |
| 6,805,092 | B2 * | 10/2004 | Chang | 123/306 |
| 6,837,213 | B1 | 1/2005 | Burnett | |
| 7,104,251 | B2 * | 9/2006 | Kim | 123/306 |
| 2007/0144504 | A1 * | 6/2007 | Kennedy | 123/592 |

* cited by examiner

*Primary Examiner* — Erick Solis

(57) ABSTRACT

The air intake accessory includes a housing containing a non-electric fan. The housing has an inlet and outlet each of which connects between the air filter and engine on the air intake line. The housing has a nozzle along the side of the fan closest the air filter, which speeds up movement of the intake air. The inclusion of the nozzle and non-electric fan improves fuel efficiency and engine performance.

4 Claims, 3 Drawing Sheets

AIR INTAKE ACCESSORY FOR AN AUTOMOBILE ENGINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of internal combustion engine's air intake, more specifically, an accessory that fits in line with the air intake of an engine and of which improves fuel efficiency.

B. Discussion of the Prior Art

As a preliminary note, it should be stated that there is an ample amount of prior art that deals with improving the fuel efficiency of internal combustion engines via the air intake. As will be discussed immediately below, no prior art discloses an air intake accessory that boosts fuel efficiency via a non-electric fan.

The Burnett Patent (U.S. Pat. No. 6,837,213) discloses a device that is inserted into the air intake system of a motor vehicle in order to save fuel and boost power. However, the of air movement, as opposed to a non-electric fan that spins as air enters the device and of which boosts the volumetric flow rate of the air in order to improve fuel efficiency.

The Robley, Jr. Patent (U.S. Pat. No. 6,550,446) discloses an air intake flow device that directs the airflow entering an internal combustion engine into a vortex. Again, the device does not have any moving pats but merely creates a vortex of air movement, as opposed to a non-electric fan that spins as air enters the device and of which boosts the volumetric flow rate of the air in order to improve fuel efficiency.

The Kim Patent (U.S. Pat. No. 6,158,412) discloses a device that is used to create a swirling, turbulent flow of air, which enters an internal combustion engine. However, the device does not have any moving parts, as opposed, to a non-electric fan that rotates due to the movement of the air intake across said fan.

The Kim Patent (U.S. Pat. No. 5,113,838) discloses an air flow system for an internal combustion engine comprising an air cleaner and a swirling device that improves the performance of the engine. Again, the device does not have any moving parts, as opposed to a non-electric fan that rotates due to the movement of the air intake across said fan.

The Kim Patent (U.S. Pat. No. 5,947,081) discloses an air flow system for an internal combustion engine that creates an air swirl. Again, the device does not have any moving parts, as opposed to a non-electric fan that rotates due to the movement of the air intake across said fan.

The Tornado Air System, a non-patent piece of prior art, teaches the use of a device that has no moving parts, but creates turbulence via a vortex inside of the carburetor of an engine.

While the above-described devices fulfill their respective and particular objects and requirements, they do not describe an air intake accessory that has a non-electric fan that moves via the incoming intake air, which improves fuel efficiency and engine performance. In this regard, the air intake accessory means departs from the conventional concepts and designs of the prior art.

SUMMARY OF THE INVENTION

The air intake accessory includes a housing containing a non-electric fan. The housing has an inlet and outlet each of which connects between the air filter and engine on the air intake line. The housing has a nozzle along the side of the fan closest the air filter, which speeds up movement of the intake air. The inclusion of the nozzle and non-electric fan improves fuel efficiency and engine performance.

An object of the invention is to provide a air intake accessory that improves fuel efficiency and engine performance.

A further object of the invention is to provide an air intake accessory that is easy to install on any vehicle's air intake line.

A further object of the invention is to provide an air intake accessory that is affordable.

These together with additional objects, features and advantages of the air intake accessory will be readily apparent to those of ordinary skill in the art upon reading the following detailed description of presently preferred, but nonetheless illustrative, embodiments of the air intake accessory when taken in conjunction with the accompanying drawings.

In this respect, before explaining the current embodiments of the air intake accessory in detail, it is to be understood that the air intake accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the air intake accessory. It is therefore important that the claims be regarded as including such equivalent construction insofar as they do not depart from the spirit and scope of the air intake accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
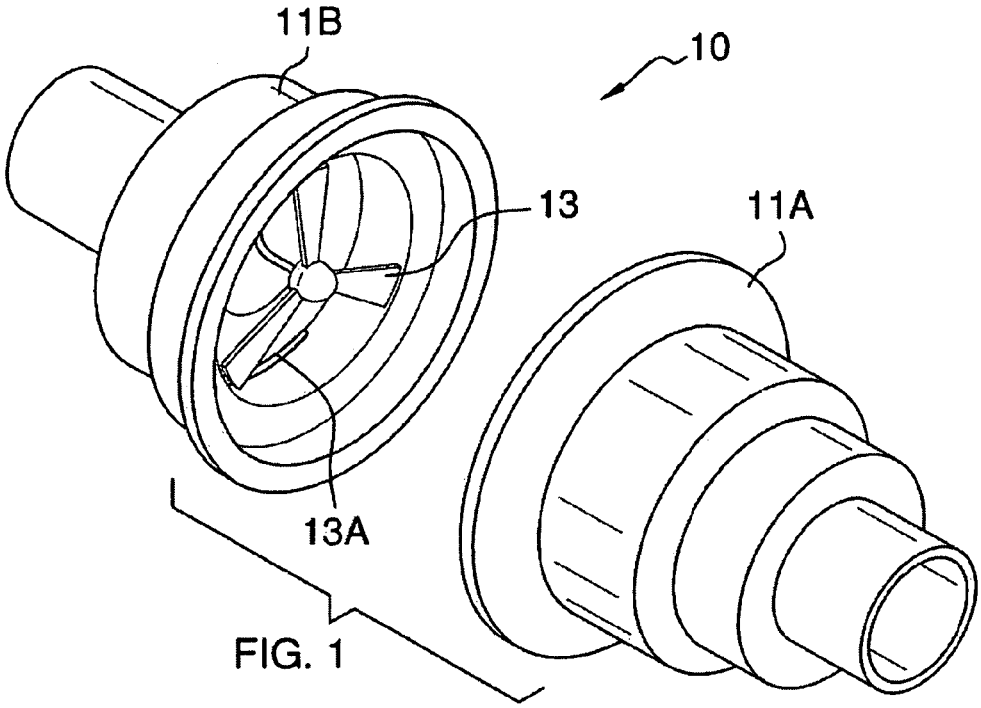
FIG. 1 illustrates an isometric view of the invention with the housing separated to reveal the non-electric fan included within.
Figure 2:
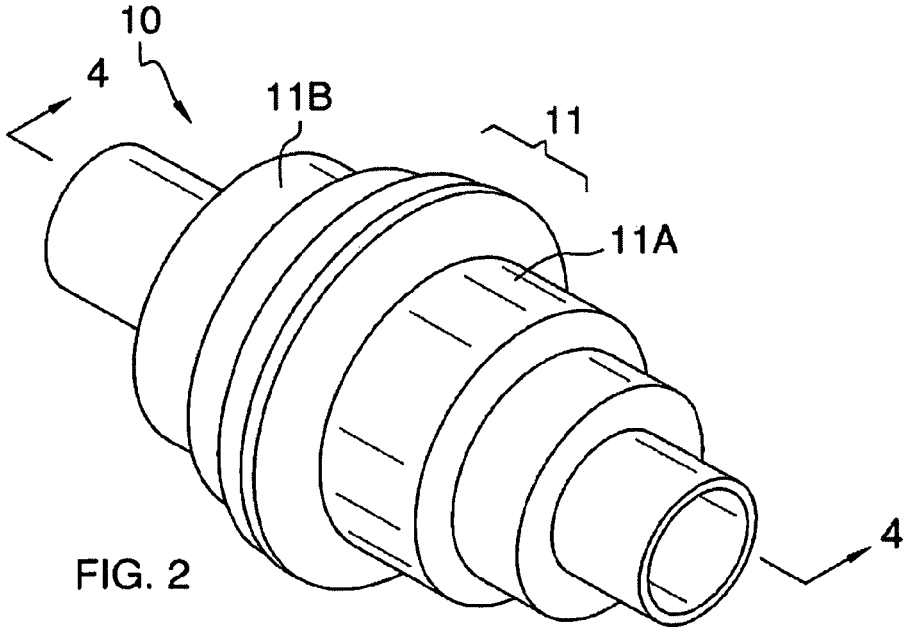
FIG. 2 illustrates an isometric view of the housing connected.
Figure 3:
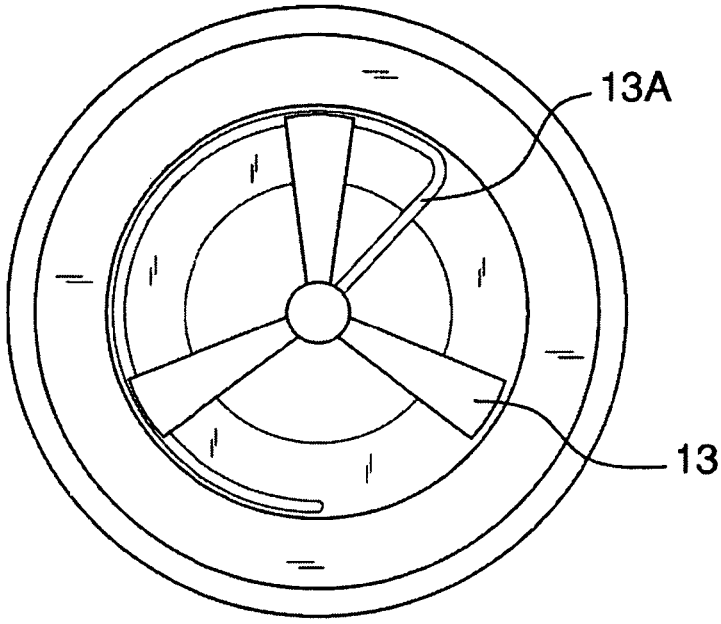
FIG. 3 illustrates a side view of the housing separated and revealing the non-electric fan.
Figure 4:
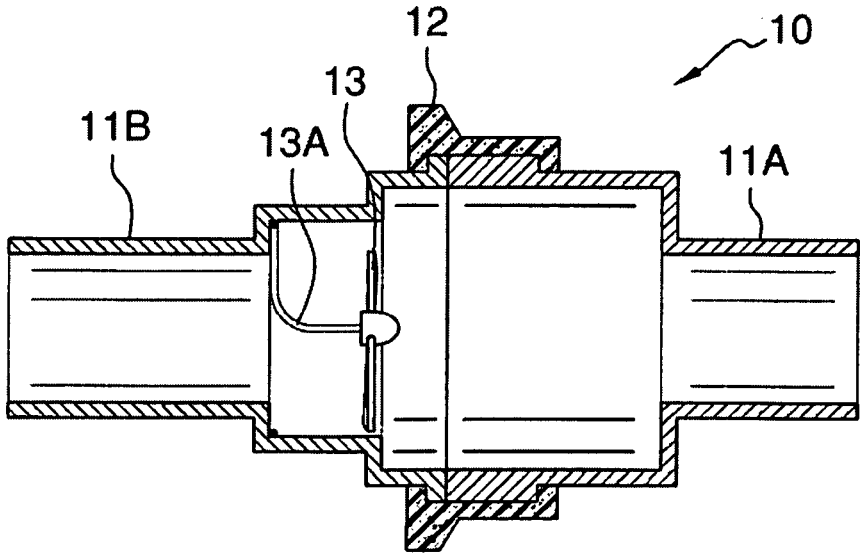
FIG. 4 illustrates a cross-sectional view of the invention along line 4-4 in FIG. 2.
Figure 5:
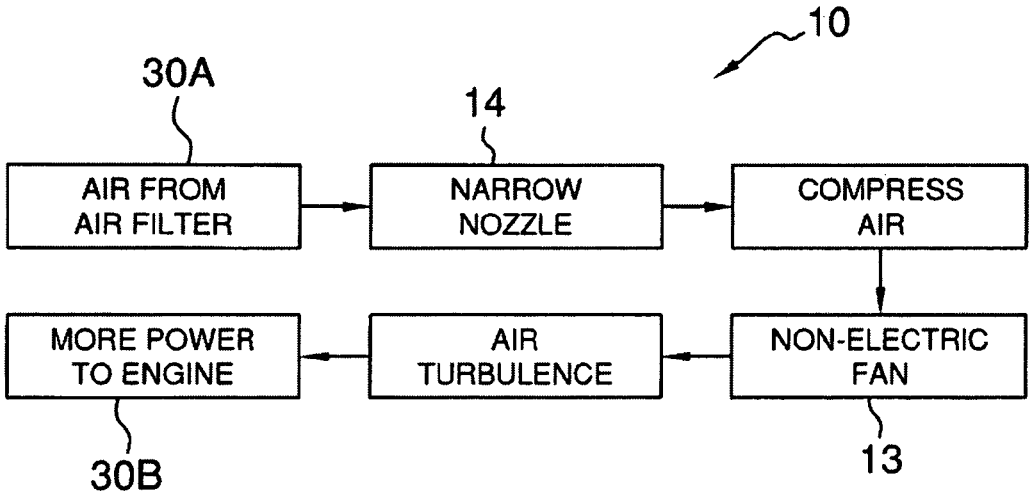
FIG. 5 illustrates a diagram of the various stages the air intake undergoes when the invention is installed on the air intake line.

Detailed reference will now be made to the preferred embodiment of the present invention, examples of which are illustrated in FIGS. 1-5. A air intake accessory 10 (hereinafter invention) includes a housing 11 having a first end 11A and a second end 11B. Both the first end 11A and the second end 11B attach to an air intake line 30 of an internal combustion engine. The first end 11A attaches closest to an air filter 30A, whereas the second end 11B attaches closest an engine 308.

The first end 11A may have a nozzle 14, which compresses the air as it enters the housing 11 and prior to interacting with the fan 13.

The first end 11A and the second end 11B are sealed and secured together via a shoulder bracket 12. Located in the second end 11B is a fan 13. The fan 13 rests inside of the second end 118 via a fan bracket 13A. The fan 13 is not electric or powered by any auxiliary power source. Rather the fan 13 is powered by movement of the air intake within the air intake line 30. The fan 13 creates turbulence within the air, which in turn improves atomization with fuel inside of the engine cylinder(s).

The housing 11, the shoulder bracket 12, and the fan 13 re made of materials comprising a plastic or metal.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An air intake accessory for internal combustion engines comprising:

(a) a housing;

wherein the housing is of hollow construction;

wherein the housing is fitted in line between an air filter and the engine of an air intake line;

(b) a fan;

wherein the fan is mounted within the housing and is free to rotate inside of the housing;

wherein the housing has a nozzle located on the side of the fan closest the air filter, which in turn compresses the air prior to interacting with the fan;

wherein the fan rests inside of the housing via a fan bracket;

wherein the fan is only powered by movement of the air intake, which creates turbulence within the air that improves atomization with fuel.

2. The air intake accessory as described in claim 1 wherein the housing and fan are made of a material comprising a metal or plastic.

3. An air intake accessory for internal combustion engines comprising:

(a) a housing;

wherein the housing is of hollow construction;

wherein the housing is of two-part construction comprising a first end and a second end;

wherein the housing is fitted in line between an air filter and the engine of an air intake line;

wherein the first end is attached along the air intake closest the air filter;

wherein the second end is attached along the air intake closest the engine;

(b) a shoulder bracket;

wherein the shoulder bracket seals and secures the first end to the second end of the housing;

(c) a fan;

wherein the fan is mounted within the housing and is free to rotate inside of the housing;

wherein the first end of the housing has a nozzle, which in turn compresses the air prior to interacting with the fan;

wherein the fan rests inside of the second end via a fan bracket;

wherein the fan is only powered by movement of the air intake, which creates turbulence within the air that improves atomization with fuel.

4. The air intake accessory as described in claim 3 wherein the housing, shoulder bracket, and fan are made of a material comprising a metal or plastic.

* * * * *